US007166758B2

(12) United States Patent
Nunez et al.

(10) Patent No.: US 7,166,758 B2
(45) **Date of Patent: *Jan. 23, 2007**

(54) FOAM AND GEL METHODS FOR THE DECONTAMINATION OF METALLIC SURFACES

(76) Inventors: Luis Nunez, 4631 W. Schubert Ave., Chicago, IL (US) 60639; Michael Donald Kaminski, 16350 Deer Run Dr., Lockport, IL (US) 60441

( * ) Notice: Subject to any disclaimer, the term of this patent is extended or adjusted under 35 U.S.C. 154(b) by 0 days.

This patent is subject to a terminal disclaimer.

(21) Appl. No.: 11/089,978

(22) Filed: Mar. 26, 2005

(65) Prior Publication Data

US 2006/0217584 A1 Sep. 28, 2006

(51) Int. Cl.

| | |
|---|---|
| ***G21F 9/00*** | (2006.01) |
| ***B08B 7/00*** | (2006.01) |
| ***B08B 3/00*** | (2006.01) |
| ***B08B 3/14*** | (2006.01) |
| ***C11D 3/00*** | (2006.01) |

(52) U.S. Cl. ..... 588/18; 588/901; 510/110; 134/3; 134/22.14; 134/28; 134/41; 976/DIG. 376

(58) Field of Classification Search ..... 588/1, 588/18, 901; 510/110; 134/3, 28, 22.14, 134/22.19, 41, 42; 976/DIG. 376
See application file for complete search history.

(56) References Cited

U.S. PATENT DOCUMENTS

| | | | | | |
|---|---|---|---|---|---|
| 3,615,817 | A * | 10/1971 | Jordan et al. | ..... | 134/3 |
| 3,873,362 | A * | 3/1975 | Mihram et al. | ..... | 134/3 |
| 4,009,116 | A * | 2/1977 | Bahr et al. | ..... | 588/8 |
| 4,249,949 | A * | 2/1981 | Wooler et al. | ..... | 588/8 |
| 4,810,405 | A * | 3/1989 | Waller et al. | ..... | 510/253 |
| 4,980,072 | A * | 12/1990 | Augustin et al. | ..... | 210/735 |
| 5,078,894 | A | 1/1992 | Horwitz et al. | | |
| 5,332,531 | A | 7/1994 | Horwitz et al. | | |
| 5,421,906 | A * | 6/1995 | Borah | ..... | 134/26 |
| 5,434,331 | A | 7/1995 | Barkatt et al. | | |
| 5,468,456 | A | 11/1995 | Nunez et al. | | |
| 5,512,202 | A * | 4/1996 | Borah | ..... | 510/110 |
| 5,587,142 | A | 12/1996 | Horwitz et al. | | |
| 5,666,641 | A * | 9/1997 | Abney et al. | ..... | 423/2 |
| 5,728,660 | A * | 3/1998 | Borah | ..... | 510/110 |
| 5,961,736 | A * | 10/1999 | Borah et al. | ..... | 134/26 |
| 6,203,624 | B1 * | 3/2001 | Bargues et al. | ..... | 134/3 |
| 6,475,296 | B1 * | 11/2002 | Gauchon et al. | ..... | 134/40 |
| 6,504,077 | B1 | 1/2003 | Purohit et al. | | |
| 6,827,090 | B1 * | 12/2004 | Nurnberger et al. | ..... | 134/22.1 |
| 2003/0158459 | A1 * | 8/2003 | Tucker | ..... | 588/200 |
| 2003/0191352 | A1 * | 10/2003 | Bradbury et al. | ..... | 588/16 |
| 2004/0077519 | A1 * | 4/2004 | Price et al. | ..... | 510/499 |

* cited by examiner

*Primary Examiner*—Steven Bos
*Assistant Examiner*—James Fiorito

(57) ABSTRACT

Decontamination of nuclear facilities is necessary to reduce the radiation field during normal operations and decommissioning of complex equipment. In this invention, we discuss gel and foam based diphosphonic acid (HEDPA) chemical solutions that are unique in that these solutions can be applied at room temperature; provide protection to the base metal for continued applications of the equipment; and reduce the final waste form production to one step. The HEDPA gels and foams are formulated with benign chemicals, including various solvents, such as ionic liquids and reducing and complexing agents such as hydroxamic acids, and formaldehyde sulfoxylate. Gel and foam based HEDPA processes allow for decontamination of difficult to reach surfaces that are unmanageable with traditional aqueous process methods. Also, the gel and foam components are optimized to maximize the dissolution rate and assist in the chemical transformation of the gel and foam to a stable waste form.

2 Claims, 5 Drawing Sheets

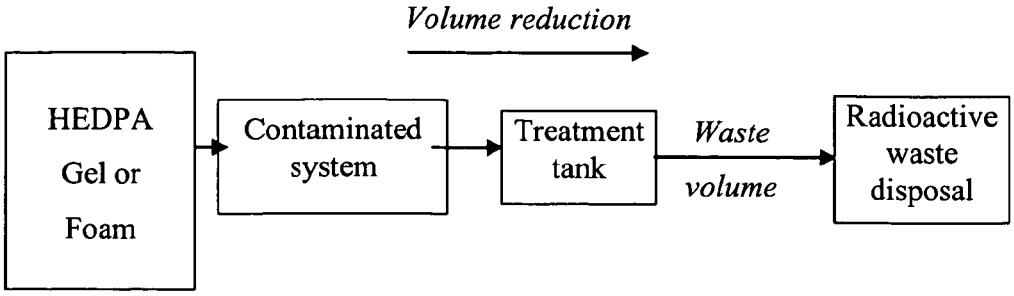
FIGURE 1. SCHEMATIC DIAGRAM OF HEDPA FOAM OR GEL DECONTAMINATION PROCESSES FOR SURFACE CONTAMINATED SYSTEMS.

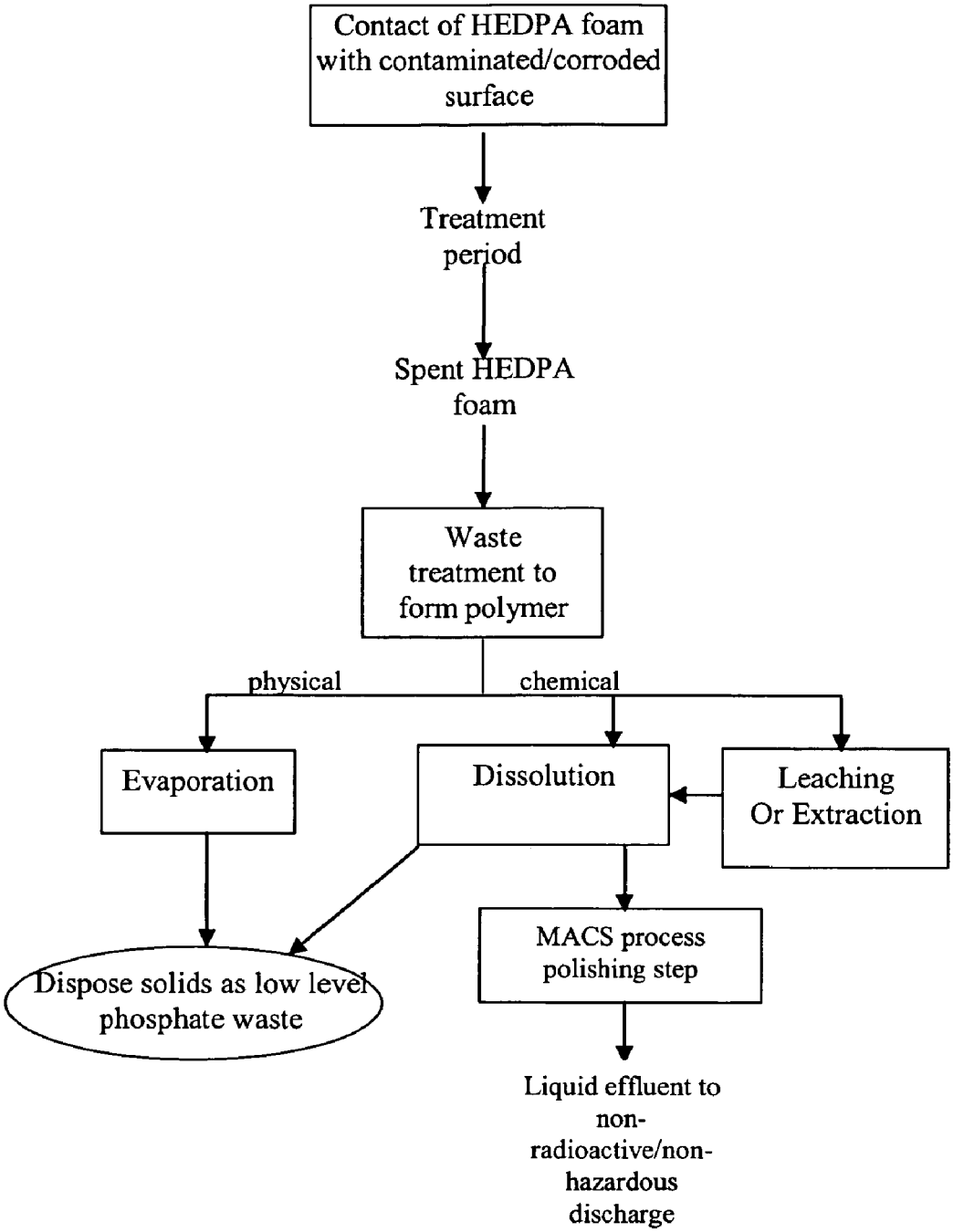
FIGURE 2. CLOSED LOOP CYCLE FOR THE DECONTAMINATION OF FERROUS METALS USING HEDPA FOAMS

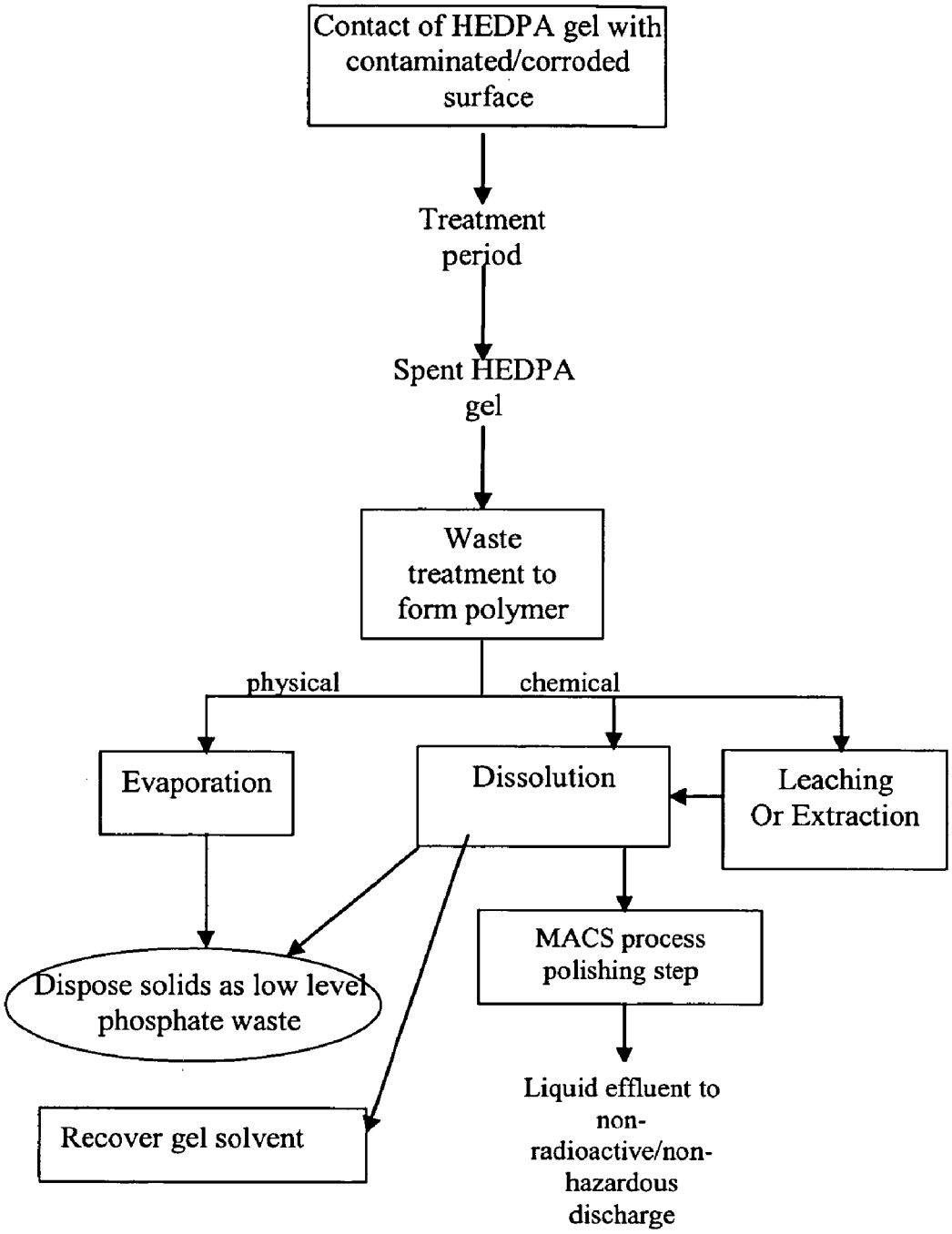
FIGURE 3. CLOSED LOOP CYCLE FOR THE DECONTAMINATION OF FERROUS METALS USING HEDPA GELS

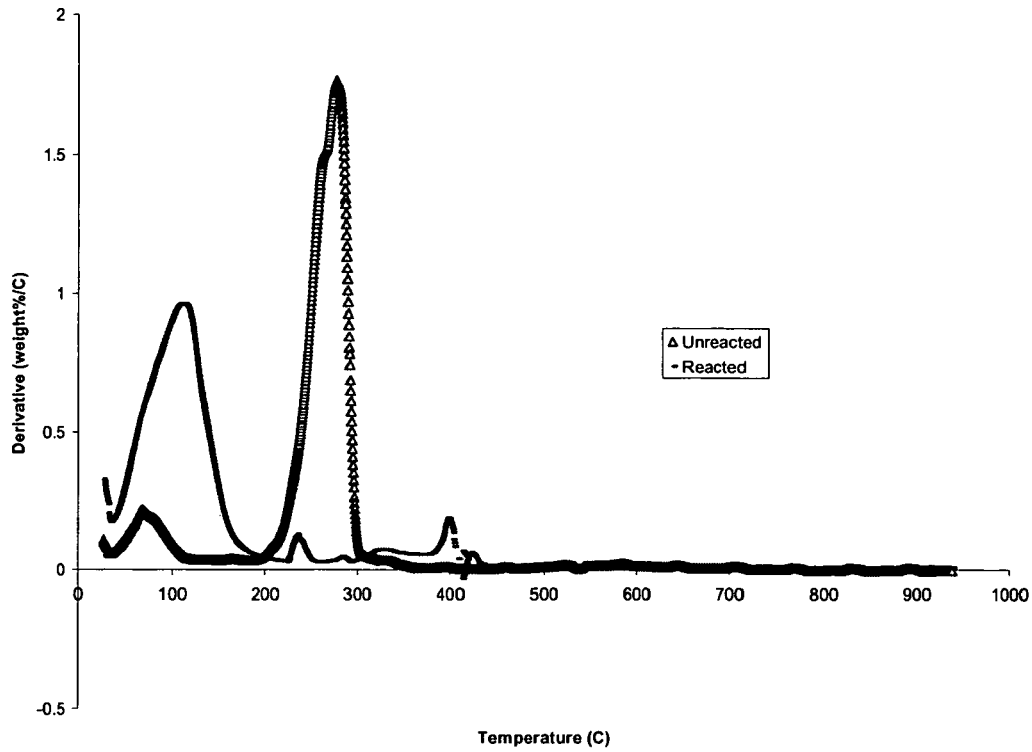
FIGURE 4. A SCHEMATIC DIAGRAM OF A TGA SPECTRUM OF UNREACTED GEL AND A SPECTRUM OF A HEDPA GEL USED TO DECONTAMINATE FERROUS METALS. THE $C_{10}$MIMCL/HEDPA RATIO WAS 10:1.

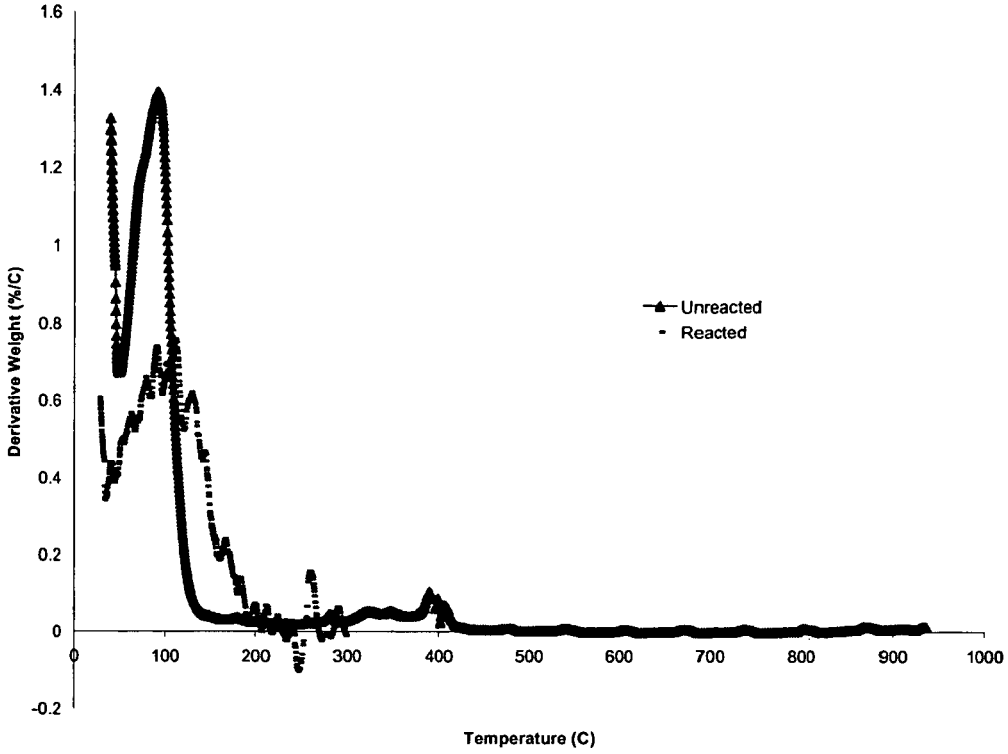
FIGURE 5. A SCHEMATIC DIAGRAM OF A TGA SPECTRUM OF UNREACTED GEL AND A SPECTRUM OF A HEDPA GEL USED TO DECONTAMINATE FERROUS METALS. THE $C_{10}$MIMCL/HEDPA RATIO WAS 2:1.

FOAM AND GEL METHODS FOR THE DECONTAMINATION OF METALLIC SURFACES

United State Government has rights in this invention pursuant to Contract No. W-31-109-ENG-38 Between the U. S. Department of Energy and the University of Chicago representing Argonne National Laboratory.

TECHNICAL FIELD

This relates to decontamination and/or separation of radioactive and hazardous compounds from surfaces and/or solutions.

BACKGROUND OF THE INVENTION

In the nuclear power industry, radioactive contamination can generally be found (1) in solutions and (2) on surfaces. Aqueous treatment processes are used for high concentrations of radioactive contaminants in solution. Chemical decontamination technique have been used to decontaminate stainless steel components, other iron-based steel and alloys, metal surfaces, structural materials and equipment (e.g., glovebox, radioactive cells, process apparatus). Standard chemical dissolution can be achieved by injecting, circulating, and draining the chemical components (e.g., values and tools). Decontamination of nuclear facilities is necessary to reduce radiation field during normal operations and decommissioning of complex equipment. The complexity of equipment and location of radioactive contaminants in hard to reach places makes conventional aqueous processes cumbersome. Customary gel and/or foam decontamination processes are used to decontaminate hard to treat structures, however, neither gels or foams have shown the selectivity toward the decontamination of radioactive components for extensive commercial applications. Furthermore, the final disposal of the foams and gels are also awkward, and in this patent we demonstrate a new process that addresses the above mentioned issues.

A variety of chemicals are used to decontaminate surfaces including organic acid, complexants, and mineral acids see for instance Nunez et al. U.S. Pat. No. 6,504,077 issued January 2003, Horwitz et al. U.S. Pat. No. 5,078,894 issued January 1992, U.S. Pat. No. 5,332,531 issued Jul. 26, 1994, U.S. Pat. No. 5,587,142 issued December 1996 and the disclosures that are incorporated herein by reference. The Waller et al U.S. Pat. No. 4,810,405 issued March 1989 is also incorporated by reference. Strong acids will dissolve oxide scale; however, they will also dissolve the metallic substrate and have limited solubility in gel or foam systems. Weak acids such as organic acids (e.g., citric acid, oxalic acid, EDTA) are also added into decontamination solvents with the purpose of dissolving and complexing the dissolved metal oxide components. Additionally, the formation of gels and foams with the weak organic acids has shown negligible decontamination of surfaces. Various reviews have evaluated the need of Decontamination & Decommissioning (D&D) of surfaces and equipment within Department of Energy (DOE) and surveyed D&D processes suitable to DOE and industrial applications. In general, decontamination of equipment prior to decommissioning does not require the protection of the base metal. However, gel and foam processing can led to more efficient processing and reduce waste generation. In the current invention we discuss gel and foam based HEDPA chemical solutions which are unique in that they can provide protection to the base metal for continued application of the equipment and reduce the final waste form production to one step. The HEDPA based gels and foams can even be applied at room temperature which has not been effective in radioactive decontamination processes. Gel and foam based HEDPA processes allow for decontamination of difficult to reach surfaces unmanageable with traditional aqueous process methods. Also, the gel and foam components are optimized to maximize the dissolution rate and assist in the chemical transformation of the gel or foam to a stable waste form.

Radioactive decontamination techniques of stainless steel components, other iron-based steels and alloys, metal surfaces, and other structural materials e.g., concrete, tools, etc. have been unsatisfactory for many applications due to ineffective scale removal, target specificity (i.e. damage to the metal substrate), or waste handling problems. Chemical decontamination is achieved by the use of solvents to dissolve contaminated films or scale from the steel or metal substrates. Oxide scales are formed on stainless steels, iron-based alloys, and other non-ferrous surfaces in water systems at low and high temperatures and pressures. The dissolution of oxide scales can be achieved by injecting, circulating, and draining the chemical solvents from large equipment e.g. tanks, interior surfaces of pipes, coolant pipes and steam generators, and other facility components e.g., valves, tools. Decontamination of nuclear facilities is necessary to reduce radiation fields during daily operation, to facilitate eventual equipment handling and repairs, and for decommissioning and release of equipment and reuse of components. Currently, there are many available chemical techniques that can dissolve scales or films formed on ferrous metals, each with associated limitations. In order to develop more efficient chemical decontamination solvents, it is important to understand the formation of oxide scales. For boiling water reactors (BWRs) and pressurized water reactors (PWRs) there is a good chemical understanding of oxide scale and/or film formation.

Oxide Scale Formation

In general, there are two types of oxide scales formed in pipe interiors from commercial water-cooled reactors. The scale material serves as a trap for contaminants flowing in the coolant system. The exact composition of the scales is dependent on the type of commercial reactor (see TABLE 1) and coolant system chemistry (which may vary significantly from reactor site to site). Typically two layers form. The inner layer is formed by corrosion of the metallic or alloy substrate and an outer layer, which, in general, is not strongly adhered to the substrate, is formed typically by a combination of corrosion, precipitation, and deposition of crud from the coolant.

TABLE 1

General description of oxide scale formation in commercial PWR's and BWR's.

| Parameters | PWR's | BWR's |
|---|---|---|
| Conditions | Elevated temperatures and pressure. Reducing condition of coolant | Oxidizing condition of coolant |
| Inner layer | Magnetite, chromium (III) oxide<br>High level of activity and difficult to remove | Magnetite, hematite, nickel ferrite<br>$NiO.Fe_2O_3$, Cr depleted |
| Outer layer | Fe - rich<br>Ni - rich | Hematite |
| Decontamination | Difficult to remove due to insolubility<br>Cr (III)→Cr (IV) in order to dissolve with decontamination solvent | Oxide films soluble in acid |

This invention relates generally to the dissolution and treatment of minerals, oxides, scales typically found in both the BWRs and PWRs systems and other industrial facilities. Using HEDPA based foams or gels which are: (1) easy to process, (2) more efficient than conventional foams and gel systems, (3) less damaging to the metallic surfaces than aqueous processes, and (4) relatively easy to dispose of and provides the nuclear industry with better options in treatment of current contamination problems and future D&D activities. FIG. 1 illustrates general stages of a HEDPA based foam and gel decontamination processes.

Contaminants in coolant systems are located in horizontal pipes, valves, pumps, heat exchanger, etc. The contaminants originate from activation and migration of dissolved stainless steel components (TABLE 2) or in some cases from defects in the fuel that permit the migration of fission products and actinides.

TABLE 2

Some major activation products found as contaminants in commercial reactors.

| Isotope | Half life (years) |
|---|---|
| $^{54}Mn$ | 0.86 |
| $^{59}Fe$ | 0.12 |
| $^{55}Fe$ | 2.68 |
| $^{59}Ni$ | $7.6 \times 10^9$ |
| $^{58}Co$ | 0.19 |
| $^{60}Co$ | 5.27 |
| $^{63}Ni$ | 100 |

Chemical Decontamination Processes

Various chemicals are used to decontaminate surfaces including organic acids, complexants, and mineral acids, see for instance Horwitz et al. U.S. Pat. No. 5,078,894 issued January, 1992, U.S. Pat. No. 5,332,531 issued Jul. 26, 1994, and U.S. Pat. No. 5,587,142 issued December, 1996 and the disclosure of which are incorporated herein by reference. The Waller et al. U.S. Pat. No 4,810,405 issued March, 1989 is also incorporated by reference. Many mineral acids (e.g., HF, $HNO_3$, $H_2SO_4$) are used in decontamination solvents to dissolve oxide scales. Strong acids will dissolve the oxide scales; however they will also dissolve the metallic substrate. Typical dissolution rates of unreacted metals in mineral acids are significantly higher than the dissolution rate of oxidized metal. The dissolution of the metal substrate will deplete the acid effectiveness toward the oxide scale dissolution, increase waste volume, and compromise the structural integrity. Weak acids such as the organic acids (e.g., citric acid, oxalic acid, EDTA) are also added into decontamination solvent with the dual purpose of dissolving and complexing the dissolved metal oxide components. The presence of chelating agents such as EDTA and citric acid with contaminated waste stream pose major problems during the volume reduction phase of the process. Ion exchange columns or sorption beds are less effective when organic complexing agents are in solution. EDTA and other complexing agents have high thermal and hydrolytic stability and their destruction requires harsh conditions and still can generate interfering species.

Most decontamination agents work primarily by dissolving the unreacted metal surface and uplifting the underlying grains and are ineffective dissolution agents. This type of decontamination is not preferred in many decontamination scenarios since solids can accumulate in any dead leg or in elbows and lead to radioactive hotspots.

Various reviews have evaluated the need for decontamination and decommissioning (D&D) within Department of Energy (DOE) and surveyed D&D processes suitable for DOE applications [L. Chen et al, "*A Survey of Decontamination Processes Applicable to DOE Nuclear Facilities*", Argonne National Laboratory, ANL97/19 (1997)]. In general, decontamination of equipment prior to decommissioning does not require the protection of the base metal and thus may utilize the more aggressive decontamination agents; however, the acid treatment creates large volumes of waste that requires disposal. The chemical HEDPA is unique in that it can provide both protection to the base metal (important for continued operation of equipment) and large decontamination factors required for decommissioning.

A few major drawbacks of aqueous or liquid solution decontamination processes even HEDPA based systems are (1) the generation of large effluent and waste volumes, and (2) the relatively short contact periods between the solution and the contaminated surface. HEDPA based gel and foam decontamination systems address these drawbacks.

Foam and Gel Decontamination Processes

Foams, gels, and pastes are generally media for the chemical decontamination agents, but do not act as the decontamination agents. In the case of foams, the foams are typically pressurized with a gas such as air, $CO_2$, or $N_2$ the primary foaming agent mix with the decontamination agent to form the decontamination foam and force it out through a nozzle. In the case of gels, they are typical semi-fluids or semi-solids forms with relatively low viscosity which can be applied to surfaces relatively easily with minimal aqueous volume.

Gel and foam systems can achieve reasonable Decontamination Factor (DF) (>15) after multiple applications with relatively small volumes of aqueous solutions of the decontaminating agent. Liquid waste generated by foam and gel based systems can be significantly reduced to 1 to 2% of the equivalent aqueous based process. Gels, foam, and paste allow for the decontamination of selected hot spots not easily treated by traditional aqueous methods. One of the major drawbacks of the gel and foam based systems are their low DF compared to the aqueous systems. In the following section, the state of the art for foam based decontamination processes is reviewed.

Foams

Foams typically allow for extremely versatile applications of decontamination systems not traditionally available to aqueous solutions. Some advantages of foam decontamination methods are the ability to decontaminate metallic walls, overhead surfaces, and elements of complex components in a wide range of geometrical configurations and orientations. Foams are a good process for in situ decontamination with the generation of low final waste volumes. The applications of foams allow for remote decontamination processing which reduces operator exposure to high radioactive fields. The capacity of the decontamination agent is enhanced by increased dwell time and the addition of surfactant within the foam. Foam systems can significantly reduce surface contamination by several orders by repeated applications.

Some of the disadvantages of foam systems are the relatively low DFs with a one time application, difficulty in the recirculation within large cavities, and applications where surfaces have depth crevice or crack surfaces [Oak Ridge National Laboratory, *Oak Ridge National Laboratory Technology Logic Diagram, Vol.* 2, Oak Ridge National Laboratory Report DE93016147 (1993)] Thus, scale-up applications of foam systems are still under development.

In the nuclear industry, the applications of foams have been popular. The successful applications of foams to complex equipment at both the West Valley Demonstration Project and Savannah River Site have demonstrated significant waste reduction in some cases up to 70%. [R. A. Meigs, "*Use of Foam Chemical for Decontamination*" Proceedings of the International Decommissioning Symposium, Pittsburgh, Pa., Oct. 4–8, 1987, pp IV23–IV30 (1987)][B. Guthrie, "*Foam Decontamination of Reactors and Reactor Loops. A Literature Review*", Batelle Pacific Northwest Laboratory Report HW-57642 (1958)] Industry has used foams to decontaminate glove boxes, glove boxes, and other hard to get to configurations. [J. M. Harris et al, "*A Foam Process for Application of Decontamination Agents," Decontamination of Nuclear Facilities:* International Joint Topical Meeting ANS-CAN, Niagara Falls, Canada, Sep. 19–22, 1982, pp. 4–37, 4–80 (1982)] The application of foams in closed configurations is one of the hardness and extreme care must be taken during the decontamination process.

A foam process known as COMODIN was applied in the decontamination of large heat exchanger of a French G2 reactor. The process was based on nitric and sulfuric acids with cerium sulfate. The DF obtained were between 40 and 50 for the heat exchangers and in the presence of ozone the Ce(IV) was regenerated to Ce(III) directly and the DF were about 160. [J. R. Costes et al. "Decontamination of Stainless Steel Heat Exchangers with Ozone-Enriched Foams to allow Steel Recycling" Waste Management'95, Tucson, Ariz. (1995)] However, reasonable DFs were only achieved after multiple applications of the foam. In FIG. 2 we show a diagram illustrating the general stages of a HEDPA based foam process. In the following section, we provide background and current practices of gel based decontamination processes.

Gels

Within the chemical decontamination community glycerophthalic, glycerophosphoric, silica and diopside gels are all gel forming compounds compatible with most decontamination agents. The gels are sprayed onto a component wall, allowed to work, and finally scrubbed wiped, rinsed, or pulled off. Gels can be applied with airless compressor as sprays or spread manually with tubes filled with gel.

In the manufacturing of glycerophosphoric gels, phosphoric acid is added to substances that are used to decontaminate iron or mild stainless steel. A gel is formed by dissolving concentrated $H_3PO_4$ in gylicerine, the solution is heated to 100° C. for about an hour. Next it is cooled which causes gelling (viscosity@0.7P). The decontamination agent is completed by adding one or two molar of $H_3PO_4$ or 100 mL/L of detergent paracodine 120 to the gel. The DFs are in the 20 to 45 range after multiple applications. Silica, diopside, and gylcerophthalic gels have been discussed in decontamination processes evaluations [D. Boulitrop et al. "*Specific Decontamination methods: Water Lance, Erosion by Cavitation, Application of Gel-Based Decontaminants*"][L. Chen et al, "*A Survey of Decontamination Processes Applicable to DOE Nuclear Facilities*", Argonne National Laboratory, ANL97/19 (1997)] and all are successful in decontaminating radioactive surfaces and have DF in excess of 50 after multiple applications. Gel decontamination process permit in situ decontamination of highly contaminated installation with no additional exposure to personnel. When gels are used to decontaminate smearable contamination from large surfaces DFs as high as 100 can be achieved.

Gel formation has both advantages and disadvantages. The advantages are that the waste generated and collected is typically 4–5 times less than the aqueous waste. Some of the disadvantages are that (1) the processes require at least two applications and rinsing, (2) reagent actions are limited by solution viscosity, and (3) the amount of active material in the gel film must be kept low. In FIG. 3 we show a diagram illustrating the general stages of a HEDPA based gel process.

The waste generated from the gel can be collected, neutralized, and treated using precipitation methods (DOE) and these precipitation methods typically involve the addition of other chemicals. The detrimental effects on the environment generated from the excessive chemical processing and manufacturing has lead to the study of more environmentally friendly solvents such as ionic liquids.

Ionic Liquids

Ionic liquids are environmentally friendly solvents and are also key compounds to what is referred to as Green Chemistry. Ionic liquids are a class of compounds composed of ionized species with melting points less than 100° C. The ionic liquids (ILs) are being evaluated as solvents in actinide separation processes and other applications. Their ability to solubilize a wide range of solute makes them idea for multiple chemical applications. This is the main difference between ionic liquids and molten salts. The ionic liquids have been the focus of compounds that can potentially replace organic solvents. The bottom line is that industry is looking for cleaner technology. Ionic liquids offer a compelling solution due to their unique properties: (1) They are liquids from 25° C. to in excess of 200° C., (2) ILs have negligible vapor pressure so volatile compounds can be removed by vacuum. (3) ILs are good solvents for a wide variety of compounds. (4) ILs are relatively cheap and easy to prepare. In this invention, ILs are used due to there vapor pressure and decomposition properties which allows stable formation of a final waste form from a spent HEDPA based gel or foam system.

Some ionic liquids of interests are the 1 alkyl-methyl imidazolium chloride ($C_n$rimCl) where n is between 2 and 12, im is the imidazolium, and r the methyl group, halides, tetrafluoroborate, and hexaflourophosphate, pyridinium derivatives, and alkyl substituted ammonium salt systems (is one or more RR'NX where R, R', N" are hydrogen, aryl substituted alkyl or substituted aryl group and X is halogen anion) with concentrations between 1 to 80%. Typically the longer the alkyl chain the higher the viscosity.

While the aforementioned patents and processes describe a wide variety of foam and gel formulations and methods for decontamination of metallic surfaces, all still achieve low DFs, are difficult to use, and/or generate a large amount of secondary waste. While the various foam and gel decontamination methods mentioned above provide benefits which are considerable when compared to untreated contaminated radioactive metallic surfaces the discovery of a stainless steel and carbon steel decontamination systems which is substantially better than commercial products and this invention would represent a significant advance in the art. The gel and foams are mostly based on green and benign chemical such as HEDPA, CTAB, AHA, SFS, Silica, $C_n$mimCl, polyamide/polyacralate, gylcine, which once the metal surface is decontaminated can decompose and lead to gases and simple metal oxide or polymers. The foams and gels can achieve extremely large DFs with one application and are extremely effective at room temperature usage, and does minimal damage to metallic surfaces when compared to aqueous HEDPA processing.

This invention relates to the use of a selective decontamination agent in a foam and gel solution, in particular diphosphonic acids, as substitute for conventional complexing agent or chelating agent in decontamination of radionuclide species in ferrous and nonferrous metals, using reducing/complexing agents in particular aceto-hydroxamic acid (AHA), SFS, and hydroxylamine which like the diphosphonic acids are chemically and thermally unstable (Equations 1 and 2) and allows the minimization of secondary waste from said decontamination or cleaning operations.

$$RCONHOH+H^+ + H_2O \rightarrow RCOOH + H_3NOH^+ \quad (1)$$

$$H_2SO_2 + H_2O \rightarrow H_2SO_3 + 2e^- + 2H^+ \quad (2)$$

SUMMARY OF THE INVENTION

The decontamination processes evaluated in this invention is based on HEDPA (1-hydroxyethane-1,1-diphosphonic acid) and its equivalences for this purposes, as hereinafter set forth. An extensive review of HEDPA and compounds of the diphosphonic moiety, inorganic acids, and carboxylic acids was completed by Chiarizia and Horwitz and published as "New Formulations for Iron oxides Dissolutions", Hydrometallurgy, 27, 339–360, 1991", the disclosure of which is hereby incorporated by reference. They studied the dissolution of FeOOH (or equivalently, $Fe_2O_3$ $H_2O$) and found that HEDPA combined with a reducing agent such as sodium formaldehydesulfoxylate (SFS) performed best with the fastest dissolution kinetics.

The advantage of HEDPA is that it is highly effective in dissolving ferrous oxides and retaining the dissolved components in solution. The diphosphonic acids, in general, display very strong chelating ability (high stability) for the trivalent transition metals and higher valence rare earths. Minerals such as magnetite, hematite, ferrite, and other iron-rich spinel phases, can be dissolved while the base-metal substrate is apparently unaffected. Furthermore, due to the thermal instability of diphosphonic acid (DPA), its decomposition produces innocuous species—a metal phosphate phase, $CO_2$, and $H_2O$. Both AHA and HAN will decompose into $NO_2$, $CO_2$, and diatomic gases as shown in Equation 1. Similarly, SFS decomposes to $SO_2$ and $H_2O$ as shown in Equation 2. The reducing/complexing agents are considered non-persistent due to the fact that they can be decomposed and are not detrimental environmental chemicals. Furthermore, many of the ionic liquids are water soluble and allow for easy of separation with minimal toxic chemical generation in gel and foam formulations.

BRIEF DESCRIPTION OF THE DRAWINGS

FIG. 1 is a schematic diagram of a HEDPA foam or gel decontamination processes for surface contaminated systems;

FIG. 2 is a schematic diagram of a closed loop cycle for the decontamination of ferrous metals using HEDPA foams;

FIG. 3 is a schematic diagram of a closed loop cycle for the decontamination of ferrous metals using HEDPA gels;

FIG. 4 is a schematic diagram of a TGA spectrum of unreacted gel and a spectrum of a HEDPA gel used to decontaminate ferrous metals. The $C_{10}$mimCl/HEDPA ratio was 10:1; and FIG. 5 is a schematic diagram of a TGA spectrum of unreacted HEDPA/$C_{10}$mimCl gel and a spectrum of a HEDPA/$C_{10}$mimCl gel used to decontaminate ferrous metals. The $C_{10}$mimCl/HEDPA ratio was 2:1.

DETAILED DESCRIPTION OF THE INVENTION

Oxide Dissolution Chemistry

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

Since the majority of oxide scales and films are either oxide on iron-based spinel phase minerals ($A^{2+}B_2^{3+}O_4$, where A=Fe, Zn, Co, Cu, W, Ag, Au, Pt, Ru, Rb, Pd, In, Ir, Ni or Mg and B=Fe, Al, Cr, Nd, Ce or V), it is very important to understand the mechanism of dissolution of iron oxides. Dissolution by strong acid follows the mechanisms indicated below for magnetite, hematite, and hydrated ferric oxide, respectively:

$$Fe_3O_4+8H^+ \leftrightarrows 2Fe^{3+}+Fe^{2+}+4H_2O \quad (3)$$

$$Fe_2O_3+6H^+ \leftrightarrows 2Fe^{3+}+3H_2O \quad (4)$$

$$FeO(OH)+3H^+ \leftrightarrows Fe^{3+}+2H_2O \quad (5)$$

In the case of metal oxides that have two oxidation states, redox reactions can affect the dissolution rate. Various studies have obtained the following expression for the rate of oxide dissolution: (6)

$$\frac{d\alpha}{dt} = k a_{H^+}^{0.5} a_{Fe^{2+}}^{0.5} a_{Fe^{3+}}^{-0.5} \quad (6)$$

where

α=the fraction of oxide dissolved a=activity of the species k=kinetic rate and the redox potential is determined by the reaction $$Fe^{3+}+e^- \rightarrow Fe^{2+} \quad (7)$$

According to the rate equation (6), two factors affect the rate of dissolution (a) $H^+$ concentration and (b) $Fe^{2+}/Fe^{3+}$ ratio. The dissolution rate can be increased by increasing the acid concentration while any reducing action increasing the $Fe^{2+}/Fe^{3+}$ ratio will accelerate the iron oxide dissolution. Complexing agents can be used to reduce the activity of free $Fe^{3+}$. It has been found that the dissolution of metal oxides increases with the stability constant of Fe(III) complex with the anion of the electrolyte. The combined action of the reducing agent and the chelator has been described by the mechanisms below, where (Y) designates the chelator activity of non-specified stoichiometry and charge:

$$Fe_3O_4+8H^++(Y)+2e^- \leftrightarrows 3[Fe^{2+}(Y)]+4H_2O \quad (8)$$

$$Fe_2O_3+6H^++(Y) \leftrightarrows 2[Fe^{2+}(Y)]+3H_2O \quad (9)$$

$$NiOFe_2O_3+8H^++(Y)+2e^- \leftrightarrows 2[Fe^{2+}(Y)]+Ni(Y)+4H_2O \quad (10)$$

Depending on the chemical nature of the complexant, the reaction can shift into the cathodic region that favors the iron oxide dissolution or into the anodic region that decreases dissolution. In general, a compound that would increase dissolution of iron oxide would have the following chemical features (1) increase reduction of $Fe^{3+}$, (2) strong acidity, and (3) a strong ($Fe^{3+}$) chelator. Very few compounds have all three characteristics. The commercially available HEDPA is a strong acid $pk_{a1}=1.56$, $pk_{a2}=2.20$, ($pk_{a1}+pk_{a2}=3.76$) and also a good complexant for $Fe^{3+}$ over $Fe^{2+}$[$\beta(Fe^{3+})=16.2$, ($\beta(Fe^{2+})=3.0$]. Furthermore, it is believed that HEDPA has reducing power for $Fe^{3+}$ in the dissolution of magnetite. It is also known that adding a reducing agent such as AHA will affect the dissolution rate of various forms of iron oxide. Although the exact binding mechanism has not been determined, the two phosphonic groups, each having a doubly bound oxygen and two hydroxyl groups, are bound to a single carbon atom and act as Lewis base. According to known experimental data, diphosphonic acids with, both phosphonate groups bound to the same carbon atom in the carbon backbone form the most stable complexes. This aids in the functionality of the HEDPA anion as it is free to attack a metal ion with an oxidation state of (II), (III), or higher. It has been found that the stoichiometric ratio of a lanthanide HEPDA complex was 1:3 in highly acid solution thus forming Ln (III)$H_2X_3$ complex ($X^{2-}$ is the double deprotonated diphosphonic species). This is derived by assuming that the complexation is monodentate, bidentate, and mixed mono and bidentate.

Ideally, the decontamination agent should be 1) water soluble, 2) able to remove, dissolve, and form stable complexes with scales and contaminants, 3) amenable to isolation from the system and safe disposal, 4) recyclable, 5) essentially benign to metal substrate, and 6) compatible with coolant water chemistry. HEDPA has many chemical properties that make it an ideal decontamination agent for removing scale or films deposits as well as free actinides and fission products from solution. This decontamination agent can be utilized to decontaminate steels, iron-based alloys, metals, or other structural materials e.g., concrete from commercial PWRs and BWRs to DOE, Department of Defense (DOD), and private industry applications such as naval submarines, nuclear process lines, fuel basin pools, reprocessing facilities, storage racks, evaporators, chemical processing skids, control rod assemblies and mechanisms, metallic walls, overhead surfaces, and elements of complex components in a wide range of geometrical configurations and orientations, and laboratory equipment that has become contaminated or corroded. It should be noted that HEDPA is representative for a class of diphosphonic acids disclosed in the various Horwitz et al. '894, '142 and '531 patents which are applicable to the present invention. Use of HEDPA hereafter is merely short hand for these diphosphonic acids disclosed in the '531 patent. More specifically, the useful phosphonic and diphosphonic acids are categorized by, $RCH_2PO_3H_2$ and $RCH(PO_2H_2)_2$, wherein R is an alkyl, aryl, substituted alkyl or substituted aryl group. In previous studies for the decontamination of steels, it was customary to introduce a strong oxidizing agent as part of the decontamination process. The logic behind this is to disturb the protective surface created by the Cr in the steel or in the chromium oxidized rich surface layer. The oxidizing agent (such as potassium permanganate) oxidizes the Cr to a higher valance which increases its solubility.

In the present invention, the reducing agent is used to accelerate the dissolution of iron oxides with minimal contribution to the secondary waste handling. In mechanistic studies, it has been shown that the dissolution rate of iron oxides is proportional to the concentration of reduced iron raised to a power. Therefore, the addition of a reducing agent increases the divalent iron concentration thereby increasing the dissolution rate. Furthermore, many of the preferred reducing agents are also good complexing agents which allow for increase in the dissolution rate in foams and gels.

AHA is one of the preferred reducing and complexing agents and is short hand reference for both reducing and oxidizing agents such as $Na_2S_2O_4$, $Na_2SO_3$, ascorbic acid, zinc metal or other applicable zero valence metals, metal salts or oxides, such as $SnCl_2$, $Fe(NO_3)_2$, hydroxylamine nitrate (HAN), and $H_2O_2$ to name a few. Oxidizing agents may still be desired to condition the chromium containing oxides for dissolution. Such oxidizing agents are alkaline permanganates or permanganic acid among others which serve to oxidize trivalent Cr to hexavalent Cr. In increasing the complexation of $Fe^{3+}$ and concentration of $Fe^{2+}$ during oxide dissolution, the reducing/complexing agent will increase the dissolution rate in HEDPA based gels and foams.

Hydroxamic Acids Chemistry

The formo-hydroxamic acid (FHA) and the aceto-hydroxamic acid (AHA) have been used as reducing/complexing agent in actinide separation processes [R. J. Taylor et al "*The Applications of Formo-and Aceto-hydroximic Acid in Nuclear Fuel Reprocessing*" J. Alloy Compounds 271–273, 534 (1998)]. The unique chemical characteristics of these organic acids include: (1) The oxygen donor ligand has shown a strong affinity for hard metal ions such as $Fe^{3+}$, $Al^{3+}$, $Np^{3+}$, and $Pu^{4+}$. (2) The small organic backbone ensures low solubility in hydrophobic solvents. (3) The hydroxamic acids decompose into $NO_2$ and $CO_2$. For example in 6M $HNO_3$, FHA will decompose into diatomic gases [I. May et al, "*The Formation of Hydrophilic Np(IV) Complexes and Their Potential Application in Nuclear Fuel Reprocessing*" (1998)]. More importantly, the hydroxamic acids are rapid reducing agents for Np(VI) without the reduction of U(VI) [R. J. Taylor "*The Reduction of Actinide Ions by Hydroxamic Acids*"Czech. J. Phys. 49, 617(1999)] Hydroxamic acids with a low carbon backbone, such as FHA and AHA have been shown to aid in the selective separation of Np (IV) from U(VI) by selectively forming a Np(IV) hydrophilic complex [R. J. Taylor et al "*The Oxidation of Np(IV) by Nitric Acid in* 100% *TBP and Diluted TBP/n-dodecane Solutions*" J. Alloy Compounds 271–273, 817 (1998)]. For both FHA and AHA, Taylor has shown that between 0.1 and 1M $HNO_3$ Np(IV) was preferred over U(VI) but above 1.8M $HNO_3$ some U(VI) complexation was observed. Furthermore both FHA and AHA have been reported to form a red complex with Pu(IV) ions, which transform in to the blue Pu(III). In nitric acid systems the best conditions for using the hydroxamic acids are in <3M $HNO_3$, where the hydroxamic acid hydrolysis to give hydroxylamine and the parent carboxylic acid (RCOOH) is minimized:

$$RCONHOH+H^+ + H_2O \leftrightarrows RCOOH + H_3NOH^+ \quad (1)$$

In Equation 1, R represents methyl for the aceto and hydrogen for the formo moieties. For many years, hydroxamic acids were used as colorimetric and gravimetric reagents and current interest focuses on the reduction/complexation chemistry with metals. Some of the general chemistry properties of AHAs are described below. [L. Nunez et al, "*Evaluation of Hydroxamic Acid in Uranium Extraction Process: Literature Review*", Argonne National Laboratory, ANL-00/35, (2000)]

Hydroxamic acids exist in two tautomeric forms (keto and enol). The keto-enol isomerism provides a number of sites for chelation. The keto form is predominant in acid medium and the enol form in alkaline medium [A. E. Hervey et al, "*Spectrophotometric Methods of Establishing Empirical Formulas of Colored Complexes in Solution*" J. Am. Chem. Soc. 72, 4498 (1950)].

In general, the hydroxamic acids are weak donors. The pK values for many hydroxamic acids have been determined and there value varies from 7.05 (nitrobenzohydroximic acid) to 11.33 (N-phnyl-n-buyrodhydroximic acid)[B. Chatterjee, "*Donor Properties of Hydroxamic Acids*" Coord. Chem Rev. 26, 281–303 (1978)]. The AHA has a pK value of 7.397 [M. W. Wise et al, "*An Investigation of Some Hydroxamic Acids*," J. Am. Chem. Soc. 77, 1058(1955)].

There are extensive reviews on the stability constants and complexation properties of hydroxamic acids, but many focus on the benzohydroxamic acid complexes [Chatterjee-1978]. Metals of interest for decontamination processing include Fe(III), U(VI), Zr(VI), Th(VI), Pu(VI), rare earths, and Al(III) [Baroncelli et al, "*The Complex Power of Hydroxamic Acids and Its Effect on Behavior of Organic Extractants in the Reprocessing of Irradiated Fuels: I The Complexes between Benzohydroxamic Acid and Zr, Fe(III), and U(VI)*" J. Inorg. Nucl. Chem 27, 1085–1092 (1965)], [A. Barocas et al, "*The Complex Power of Hydroxamic Acids and Its Effect on Behavior of Organic Extractants in the Reprocessing of Irradiated Fuels: II The Complexes between Benzohydroxamic Acid and Th, U(IV), and Pu(IV)*" J. Inorg. Nucl. Chem 28, 2961–2967 (1966)][V. G. Anderegg, et al, "*Hydroxamartkomplexes II. Die Anwendung der pH-Methods*" Helv. Chim. Acta 46, 1400 (1963)]. Stability constants for AHA and benzohydroxamic are shown in TABLE 3.

TABLE 3

Stability Constants for Select Cations with Hydroxamic acid

| Ions | $\log\beta_1$ | $\log\beta_2$ | $\log\beta_3$ | $\log\beta_4$ | Hydroxamic acid | reference |
|---|---|---|---|---|---|---|
| U(VI) | 8.72 | 16.77 | — | — | Benzo- | Baroncelli-1965 |
| U(IV) | 9.89 | 18 | 26.32 | 32.94 | Benzo- | Barocas-1966 |
| Pu(TV) | 12.73 | — | — | — | Benzo- | Barocas-1966 |
| Th(IV) | 9.6 | 19.81 | 28.76 | — | Benzo- | Barocas-1966 |
| Zr(IV) | 12.43 | 24.08 | — | — | Benzo- | Baroncelli-1965 |
| Fe(III) | 11.42 | 21.10 | 28.33 | — | Aceto- | Anderegg-1963 |
| Fe(III) | 12.18 | — | — | — | Benzo- | Baroncelli-1965 |
| Al(III) | 7.95 | 15.29 | 21.47 | — | Aceto- | Anderegg-1963 |
| Ce(III) | 5.45 | 9.79 | 12.8 | — | Aceto- | Anderegg-1963 |
| La(III) | 5.16 | 9.33 | 11.88 | — | Aceto- | Anderegg-1963 |
| Ca(II) | 2.4 | — | — | — | Aceto- | Anderegg-1963 |

The degradation of hydroxamic acids produces a carboxylic acid and hydroxylamine as shown in equation 11. These acid degradation boundaries are not the limiting factors in applications with HEDPA which has relatively lower acidity than the mineral acids.

$$-d[XHA]/dt = k[XHA][H^+] \quad (11)$$

Both FHA and AHA reaction kinetics are described by Equation 11, where X=aceto or formo.

TABLE 4

Kinetic Rate and Activation Energy for Hydroxamic Acids at 25° C.

| Acid | Rate Constant mol/(L · min) | Activation Energy (kJ/mol) |
|---|---|---|
| FHA | 0.016 | 77.3 |
| AHA | 0.00205 | 79.9 |

TABLE 5

Effects of Hydrogen Ion Activity on the Destruction of AHA at 25° C.

| $\{H^+\}$ M | Destruction half-life, min |
|---|---|
| 0.5 | 676 |
| 1 | 338 |
| 2 | 169 |
| 3 | 113 |
| 5 | 68 |
| 10 | 34 |

The rates and activation energies for both FHA and AHA at 25° C. are listed in TABLE 4. For AHA, the decomposition rate is 0.00205 mol/(L·min) at 25° C. with an activation energy of 79.9±2.9 kJ/mol [J. D. Glennor et al, Anal. Chem. 61 1474 (1989)]. TABLE 5 shows the half-life of degradation of AHA vs the hydrogen ion activity. As can be seen from these results, half the AHA will be destroyed in eleven hours when the hydrogen activity is 0.5 M, however, the activity decreases to about an hour at activities greater than 5M. In the presence of an organic acid such as HEDPA and IL solvents, the AHA destruction will occur in an even longer time than in low nitric acid concentrations. Barkatt et al U.S. Pat. No 5,434,331 teaches that decontamination of steam generator solid surfaces contaminated with radioactive or heavy metal species using a solution based on aceto-hydroxamic acid to decontaminate steam generator sludge or radioactive or heavy metal species using AHA in solution or on a solid support. However, Backatt et al does not teach (1) the use of AHA as a reducing agent to increase dissolution of organic chelator combined with HEDPA, (2) treatment at temperature greater than 170° C. or at time longer than two hours beyond the expected decomposition of AHA, (3) decontamination in gel and foam formulations and methods, (4) evaluate radioactive metal beyond activation products which have more complex chemistries than the transition metals, and (5) although the thermal and chemical decomposition with AHA are possible the final faith of the radioactive species were never determined with the AHA process.

Four major areas were investigated to establish the best system and mechanism for decontamination and separation of the metal ions using HEDPA foams or gels. The four areas were: (1) gel and foam formulations (2) kinetics involved in the dissolution process of different systems (3) waste volume reduction and (4) polymeric material formulations with gels and foams as final waste forms. The format for the tests that were performed was first to establish the characteristics of pure oxide dissolutions using HEDPA, evaluation of surface oxide dissolutions from actual ferrous specimens, and spent (waste) foam or gel treatment.

The inventive process is based on using HEDPA (or its equivalent as set forth above) based gel and foam solutions to dissolve the oxide scales and film containing contaminants on equipment either alone or in combination along with waste treatment processes not heretofore mentioned in the prior art, specifically the various Horwitz et al. patents or the Waller et al. patent cited herein. The dominant scale material is composed of iron and iron-nickel-chromium oxides in PWR and BWR systems. The use of HEDPA based nuclear reactor decontamination solutions and subsequent waste treatment scenario is novel.

In the scaled-up process the spent HEDPA solution containing dissolved scale components is removed from the contaminated facility (e.g., reactor coolant pipes, liquid waste storage tanks, submarine hulls) and treated to reduce disposal volume and chemically modify the untreated HEDPA. In reactor systems, the decontamination solution needs to be compatible with the reactor water chemistry during outages (as is within the skill of the art) since it is at this time when decontamination is performed. In FIG. 1, a general schematic diagram of the HEDPA gel or foam processes are illustrated. The gel and foam can be removed and a fresh coating is applied until a satisfactory decontamination factor (DF) has been achieved. This DF can vary greatly depending on the system but a DF of 6 to 15 is sufficient for most reactor coolant systems. The spent HEDPA gel or foam are then treated to reduce the waste volume and stabilized. These entire HEDPA gel and foam treatment processes are new with respect to the known prior art.

Volume reduction refers to processes that physically or chemically remove innocuous or non-target components (solvents, solutes, precipitates, colloids) from a waste stream in order to reduce the volume necessary for treatment, recycling, or disposal.

When the HEDPA gels and foams have reacted with metal oxides we have discovered it is possible to form a polymeric material upon evaporation of the liquid with possible reuse of the evaporated liquid.

Stabilization of the waste form is a general term used to describe processes that isolate physically and/or chemically hazardous or radioactive materials from environmental migration or human contact/exposure. Examples include grout, vitrification, sintering, and grouping.

Initially, iron oxide powders were used to determine the kinetics for dissolution using different HEDPA-reducing agent combinations. From this data, expectations and limitations could be better qualified for testing of actual corroded samples. In previous work, the dissolution of goethite (FeOOH), Fe in trivalent form, was studied by Chiarizia et al. and the dissolution followed first order kinetics of the form $$\ln(1-\alpha)=-kt \tag{12}$$

or the cubic rate law of the form $$(1-\alpha)^{1/3}=1-kt \tag{13}$$

where $\alpha$ varies the fraction of oxide dissolved at time t, and k is the characteristic rate constant in units of inverse time. With 1.0 M HEDPA at 80° C., the dissolution proceeded slowly reaching dissolution of ½ the goethite in 190 min ($t_{1/2}$=190 min). By addition of 0.1 M SFS to 1.0 M HEDPA, the reaction proceeded much faster, $t_{1/2}$=49 sec. Being one of the most difficult of the iron oxides to dissolve, we expected dissolution of prominent iron bearing scales typical of nuclear reactor facilities to be quick as well.

The extent of surface corrosion caused by these agents should be controllable. No less important are considerations related to the environmental impact of the decontamination agent itself. The presence of the decontamination agent should not create excessive difficulties in treating the resulting waste stream, nor should this agent constitute a pollutant or promote pollution by other agents.

EXAMPLE 1

A corroded carbon steel sheet (AISI type 1010 carbon steel, 10×15 cm) was obtained from the Naval Warfare Research Center, Carderock Division, U.S. Navy. The extensive corrosion of the surface of the as-received carbon steel sheet was brown-red and loose. This suggests the presence of predominantly amorphous hydrated $Fe_2O_3$ (as FeO and $Fe_3O_4$ are black, and hematite, $\alpha$-$Fe_2O_3$, will not dissolve in HEDPA alone). To better observe changes in the metal surface, half the sample was submerged in the HEDPA gel solution at 90° C. for a given time, creating a clear reaction or prewetting surface interface. Following testing, the sample was removed, the treated half was rinsed in warm (50° C.) deionized water, and air-dried for further analysis.

Various gel solutions as described in TABLE 6 containing HEDPA in glycerine as the solvent were heated to 100° C. after removing from the oven the viscosity was less than ambient temperature viscosity, gel was allowed to cool and applied to pieces of oxidized carbon steel and heated at 90° C. the carbon steel samples were periodically removed and allowed to return to ambient temperature and the gel was wiped off and the carbon steel samples were rinsed. The results are tabulated in TABLE 6.

TABLE 6

HEDPA gel formation in gylcerine

| HEDPA (M) | Observation |
|---|---|
| 1 | Minimal cleaning of oxide |
| 1.5 | Minimal cleaning of oxide |
| 4 | Best cleaning of oxide, oxide completely removed from surface |
| 4.4 (no gylcerine) | No good cleaning of oxide, oxide still on surface |

The optimal 4M HEDPA gel was contacted with carbon steel and heated at 90° C. as a function of time and the results are tabulated in TABLE 7. It was apparent from the use of HEDPA at 4.4M without glycerine or another polyethylene glycol the polyethylene glycol is one or more of —$(RCHOHCH_2OHCHR')_n$— where R and R' are an hydrogen, alkyl, aryl substituted alkyl or substituted aryl group and n is from 2 to greater than 10,000 as a gelling agent did not generate a reasonable cleaning of the oxide surface. Being one of the most difficult of the iron-oxides to dissolve, we expected dissolution of prominent iron-bearing scales typical of LWRs to be quick as well. In the data presented in the following subsections, estimates of the dissolution rate constants are presented based on the first order and cubic rate laws. For the sake of these estimates, the dissolution times were taken as the time required to reach 99.9% completion. Thus, by substituting $\alpha$=0.99 into Eqns. 12 and 13 one can compute a reasonable value of k for an estimated time $t_{0.99}$. The k observed for the gel is $3.29\times10^{-4}$ s which is impressive for a gel where $t_{1/2}$=36 min and comparable with the goethite dissolution at 80° C. mentioned in Chiarizia et al.

TABLE 7

Glycerine based HEDPA gel reaction at 90° C. as a function of time

| Time (hr) | Observation |
|---|---|
| 1 | Minimal cleaning of oxide |
| 2 | Minimal cleaning of oxide |
| 4 | Good cleaning of oxide, some oxide still on surface |
| 6 | Good cleaning of oxide, some oxide still on surface |
| 7 | Best cleaning of oxide, oxide completely removed from surface |

Two samples were allowed to heat 90° C. for two hours and then remained at ambient temperature for a day and the results are shown in TABLE 8. This illustrate that the contact time plays a major role in the gel decontamination more than the temperature.

TABLE 8

Glycerine based HEDPA gel reaction at 90° C. for two hours and at room temperature for 24 hours.

| Time (hr) | Observation |
|---|---|
| 2 | Good cleaning of oxide, some oxide still on surface |
| 24 | Best cleaning of oxide, oxide completely removed from surface |

EXAMPLE 2

HEDPA on silica support provides a unique method to both achieve decontamination in a gel solution and at the same time have a material that can be thermal transformed directly into a stable final vitrified or glass waste form.

HEDPA based gels containing HEDPA grafted to a silica support were prepared by mixing with a 4.2 M HEDPA solution. The grafted silica support was characterized by $H^+$ capacity of 1.3 mmol/g and P capacity of 0.68 mmol/g, with 50–100 mesh size particles. Various Silica gel/HEDPA wt % were studied at ambient temperature. Gel samples were applied to Navy carbon steel with some samples treated at ambient temperature and others were heated a 100° C. for 4 hours, all samples were allowed to cool and evaluated at room temperature. TABLE 9 shows the results of the Silica gel/HEDPA based gels. The silica gel/HEDPA ratios lower than 0.8 had the lowest viscosity and did not behave as a traditional gel. The optimal concentration and the best clean up of the corroded carbon steel was at the silica gel/HEDPA ratios 1.6 and this worked at room temperature just as good as at 100° C. Beyond the silica gel/HEDPA ratios 1.6, the gel takes a paste like characteristics. For Silica gel/HEDPA ratios greater than 2.30, phase separation occurs and a precipitate in the gel was observed. The gels can be directly converted into vitrified glass by heating the samples beyond the decomposition of HEDPA and the range of glass formation between 500° C. and 1200° C. because 90% of the grafted HEDPA support is silica.

TABLE 9

HEDPA gel formation in Silica gel containing HEDPA

| HEDPA (g) | Silica gel/ HEDPA (g) | SilicaGel/ HEDPA wt ratio | Treatment Temp° C. | Observation |
|---|---|---|---|---|
| 0.87 | 0.70 | 0.80 | 25 | Good cleaning of oxide, some oxide still on surface |
| 0.87 | 1.05 | 1.20 | 25 | Better cleaning of oxide, oxide almost completely removed from surface |
| 0.87 | 1.40 | 1.60 | 25 | Best cleaning of oxide, oxide completely removed from surface |
| 0.87 | 0.70 | 0.80 | 100 | Good cleaning of oxide, some oxide still on surface |
| 0.87 | 1.05 | 1.20 | 100 | Better cleaning of oxide, oxide almost completely removed from surface |
| 0.87 | 1.40 | 1.60 | 100 | Best cleaning of oxide, oxide completely removed from surface |

EXAMPLE 3

HEDPA based decontamination solutions were studied with gels which have a sponge effect of absorption of liquid solution. The crosslinked copolymeric gel material used was 70 wt %/30 wt % polyacrylamide/polyacrylate (PAM/PAC) polymer with mm grain size where the polyacrylamide polymer and the polyacrylate polymer have chemical structures of $—(RCHCONH_2)_n—$ and of $—(RCHCR'COOX)_n—$, respectively, where n can vary from 2 to 10,000. It retains approximately 50 g water per g of polymer. TABLE 10 shows the concentrations of HEDPA with AHA used. The polymeric gel was mixed and heated at 50° C. to accelerate the gelling process. Once the liquid was contained in the solid swollen gel, samples were used to clean carbon steel samples at 90° C. for one hour. The samples were taken out of the oven and allowed to cool at room temperature. The samples were extremely free of oxide at the locations where the gel was in contact with the surface.

TABLE 10

Gel formulation using 70/30 PAM/PAC with HEDPA solutions with heating at 50° C. for one hour.

| HEDPA (g) | PAM-PAC (g) | PAM-PAC/ HEDPA mass ratio | HEDPA (M) | AHA (M) | Observation |
|---|---|---|---|---|---|
| 1 | 10 | 10 | 1.01 | 0.01 | Gel was formed with agitation, very low viscosity |
| 1 | 5 | 5 | 1.85 | 0.01 | Gel was formed with agitation |
| 1 | 3 | 3 | 2.77 | 0.01 | Gel was formed with agitation |

TABLE 10-continued

Gel formulation using 70/30 PAM/PAC with HEDPA solutions with heating at 50° C. for one hour.

| HEDPA (g) | PAM-PAC (g) | PAM-PAC/ HEDPA mass ratio | HEDPA (M) | AHA (M) | Observation |
|---|---|---|---|---|---|
| 1 | 2 | 2 | 3.69 | 0.01 | Gel was formed with agitation |
| 1 | 1 | 1 | 5.54 | 0.01 | Gel was formed with agitation |

The IL, 1-decyl-3-methylinidiazolium chloride ($C_{10}$mimCl), used was soluble with all concentrations of HEDPA with AHA and/or SFS. The $C_{10}$mimCl was prepared using equal molar chorododecane and 1-methylimiadazole and heated at 60° C. for 24 hours. The phases were separated and washed with ethyl acetate and the IL is placed in vacuum at 70° C. to remove wash solvent. As shown in TABLE 11 all $C_{10}$mimCl/HEDPA ratios formed reasonable gels. Samples were used to clean carbon steel samples at 90° C. for one hour. The samples were taken out of the oven and allowed to cool at room temperature. The oxide was completely removed from the sample surface.

TABLE 11

Gel formulation using the IL $C_{10}$mimCl with 11.09M HEDPA solution at room temperature

| HEDPA (mL) | $C_{10}$mimCl (mL) | $C_{10}$mimCl/ HEDPA vol ratio | HEDPA (M) | Observation |
|---|---|---|---|---|
| 1 | 10 | 10 | 1.01 | Gel was formed with agitation, very low viscosity |
| 1 | 5 | 5 | 1.85 | Gel was formed with agitation |
| 1 | 3 | 3 | 2.77 | Gel was formed with agitation |
| 1 | 2 | 2 | 3.69 | Gel was formed with agitation |
| 1 | 1 | 1 | 5.54 | Gel was formed with agitation |

EXAMPLE 4

The IL, Cethyltrimethylammonium Bromide (CTAB), was used to generate foams and was soluble with all concentrations of HEDPA with AHA and/or SFS. TABLE 12 shows the concentration and formation of foams with HEDPA solutions.

TABLE 12

Foam formulation using the IL CTAB with HEDPA solutions at room temperature

| HEDPA (mL) | CTAB (mL) | CTAB/ HEDPA vol ratio | HEDPA (M) | Observation |
|---|---|---|---|---|
| 1 | 10 | 10 | 1.01 | Foam was formed with agitation |
| 1 | 5 | 5 | 1.85 | Foam was formed with agitation |
| 1 | 3 | 3 | 2.77 | Foam was formed with agitation |

TABLE 12-continued

| Foam formulation using the IL CTAB with HEDPA solutions at room temperature | | | | |
|---|---|---|---|---|
| HEDPA (mL) | CTAB (mL) | CTAB/ HEDPA vol ratio | HEDPA (M) | Observation |
| 1 | 2 | 2 | 3.69 | Foam was formed with agitation |
| 1 | 1 | 1 | 5.54 | Foam was formed with agitation |

EXAMPLE 5

A foam based on polymethylene polyphenyl iscocynate, methylene bisphenyl isocyanate, polyethylene glycol, and alcohol with concentrations between 1% to 80% was used with the aqueous HEDPA based solutions. The following polyisocyanates can also be used: 1,6-hexamethylene diisocyanate, 1,4-butylene diisocyanate, furfurylidene diisocyanate, 2,4-toluene diisocyanate, 2,6-toluene diisocyanate, 2,4'-diphenylmethane diisocyanate, 4,4'-diphenylmethane diisocyanate, 4,4'-diphenylpropane diisocyanate, 4,4'-diphenyl-3,3'-dimethyl methane diisocyanate, 1,5-naphthalene diisocyanate, 1-methyl-2,4-diisocyanate-5-chlorobenzene, 2,4-diisocyanato-s-triazine, 1-methyl-2,4-diisocyanato cyclohexane, p-phenylene diisocyanate, m-phenylene diisocyanate, 1,4-naphthalene diisocyanate, dianisidine diisocyanate, bitoluene diisocyanate, 1,4-xylylene diisocyanate, 1,3-xylylene diisocyanate, bis-(4-isocyanatophenyl)methane, bis-(3-methyl-4-isocyanatophenyl)methane, polymethylene polyphenyl polyisocyanates and mixtures thereof. An inert $N_2$ carrier gas was used to generate the foam and during processing the foam mixture was mixed with the aqueous HEDPA solutions shown in TABLE 13. All the various HEDPA solution with 0.001 M to 2M_AHA showed solubility in the foam and were able to clean carbon steel samples when allowed to harden for a few hours at room temperature.

TABLE 13

| Formulation using the IL CTAB with HEDPA solutions at room temperature | | | | |
|---|---|---|---|---|
| HEDPA (mL) | CTAB (mL) | CTAB/ HEDPA vol ratio | HEDPA (M) | Observation |
| 1 | 10 | 10 | 1.01 | Foam was formed with agitation |
| 1 | 5 | 5 | 1.85 | Foam was formed with agitation |
| 1 | 3 | 3 | 2.77 | Foam was formed with agitation |
| 1 | 2 | 2 | 3.69 | Foam was formed with agitation |
| 1 | 1 | 1 | 5.54 | Foam was formed with agitation |

EXAMPLE 6

As Example 6, solid samples generated from the evaporation of 0.5 molarity HEDPA/$C_{10}$mimCl with 1% of iron as magnetite dissolved in solution were analyzed by x-ray diffraction (XRD). Samples were evaporated in an oven at various temperatures (60° C. and 80° C.) to dryness. Both solid samples showed no significant difference in their XRD patterns. From peak analysis the dominant species were the polymeric $FeH_9(PO_4)_4$, $FeH_2P_3O_{10}\cdot H_2O$, and $Fe(H_2PO_4)_2\cdot 2H_2O$ species. The data suggests that the process tends to generate polymeric phosphate species.

EXAMPLE 7

To summarize, the dissolution of magnetite may be accomplished with reasonably fast kinetics with the use of HEDPA solutions alone without additional reducing agents. However, with oxides of the trivalent iron such as goethite, nickel ferrite, and hematite, the use of reducing agents is very effective in increasing the dissolution rates.

Stainless Steel Dissolution

An important expectation of HEDPA gel and foam solutions are the specificity of the acid for oxide dissolution with minimal attack to the non-reacted/non-oxidized metal substrate. This would be expected provided the HEDPA is not a sufficiently strong oxidizing agent to oxidize the base metal. To test this belief, a 304 SS coupon was placed for five days at 50° C. in a solution containing 5.0 M HEDPA and 0.1 M AHA. From careful weight measurements and optical microscopy there was no apparent change to the surface. The dissolution rate for the coupon was determined to be <0.005 mg/cm$^2$/day.

Carbon Steel

A heavily corroded piece of AISI type 1010 carbon steel was tested. The extensive corrosion of the surface of the carbon steel sheet was brown-red in color and loose. This suggests the presence of predominantly amorphous hydrated $Fe_2O_3$ (as FeO and $Fe_3O_4$ is black and hematite, $Fe_2O_3$, will not dissolve in HEDPA alone). The oxide was completely dissolved with the foam solution at room temperature and the gel after heating at 90° C. with an hour treatment time. A clear interface was obtained during the dissolution. An increase in the HEDPA and $H_3PO_4$ concentration, 5.0 M HEDPA and 6.8 M $H_3PO_4$, did not noticeably increase the rate of dissolution.

Waste Treatment

Waste treatment is the most important issue regarding the implementation of HEDPA gel and foams solutions for decontamination. After decontamination activities, the spent gel or foam liquor solution containing HEDPA, reducing agents, and dissolved metals and radioactivity must be treated and stabilized for disposal. The HEDPA, being of the thermally unstable chemicals (TUCS) family, will degrade under mild temperature and oxidizing conditions. Furthermore, so will the reducing agent which under acidic and thermal conditions will also degrade to gases. We have found two methods to accelerate degradation and subsequent destruction of HEDPA as a polyphosphonic metal polymer. The addition of AHA between 0.1 M and 2 M to a solution of>few thousand ppm of dissolved iron caused a polymerization to form within 30 minutes at 90° C. The polymerization was not positively identified but according to x-ray diffraction analysis, iron phosphates and nitrates (from AHA) may be dominant forms present. The HEDPA polymerization reaction formed by the decomposition of HEDPA will produce a solution containing low but significant quantities of radioactivity, which will disallow free-release disposal.

The final step is to remove any remaining low concentrations of radioactivity or metals from generated small-volume leached aqueous solutions from foams or gels. A polishing step that is well suited for this application is magnetically assisted chemical separation. This process disclosed in U.S. Pat. No. 5,468,456, the disclosure of which is incorporated herein by reference, utilizes micrometer-sized magnetic particles that are tailored for selective separation of hazardous/radioactive species from solution including lanthanides, fission products, and radioactive products.

Another important method available for waste treatment is through simple evaporation and solidification. From our experiments we have documented that the spent foam or gel solution of HEDPA can be evaporated to form a white polymeric solid presumably of the phosphate form which may directly amenable to silica or phosphate-based grout or glass. The evaporation process also takes advantage of the ILs low vapor pressure characteristics.

The waste treatment methods are crucial to acceptance and cost-effectiveness of this process. Depending on the situation we have devised several methods to treat the spent gel or foam—1) polymerization via AHA addition, 2) foam and gel thermal decomposition, 3) separation of aqueous components from gels and foams and 4) evaporation. Magnetic particles coated with selective ion exchange materials or solvent extractants will be used as a polishing step so that the waste solution can be released as non-radioactive waste. A diagram of the general process described in the patent is shown in FIG. 2 and FIG. 3.

As seen, our invention utilizes the instability of the HEDPA molecule which degrades with high temperature (greater than about 400° C.) or combination of temperature, catalyst and/or additional reagent (e.g., oxidizing or reducing agent) such that degradation occurs at less than about 400° C. in a gel or foam solutions. This characteristic has never been used as part of a process and was not taught prior to our invention.

Summarizing, HEDPA has a very strong affinity for metals in gel and foam solutions. Using gel and foam formulation in combination with non-persisting reducing/complexing agents to remove the metals from metallic surfaces with HEDPA is not trivial and has not been shown before. In many systems in use today ion exchange is a chosen technique to remove the dissolved species from gel and foam solution to recycle the reacting solution.

For example, to decontaminate reactors under the COMODIN gel process (ozone/cerium), the dissolved metal oxides are removed from solution via ion exchange beds with satisfactory efficiency. However, there does not exist an ion exchange material or method that can effectively remove metals bound to HEDPA for the purpose of final disposal of HEDPA with the polyvalent dissolved metals which are of interest to this patent application. Thus, no one would attempt to use this technique as a method of HEDPA recycling or waste processing to recover uranium or plutonium species, as an example. In order to use ion exchange resins for the purpose of ion exchanging the dissolved metals on the surface of the resins, HEDPA must be degraded, to produce phosphoric acid, carbon dioxide, and water. Phosphoric acid solutions are appropriate for the effective use of ion exchange resins. Alternatively, the gels and foams can be thermally treated to create a one step final vitrified or grout waste form.

In addition, evaporation in many systems yields a polymeric metal based material that can be disposed of readily. For example, one can remove iron oxides, as is practiced, from boiler tubes with treatment with hydrochloric acid. One can evaporate the reacted solution to produce an iron chloride salt or collect excess acid from the condensate, which can then be recycled. HEDPA does not evaporate to this degree. It is an aqueous soluble organic acid. Thus, it behaves in high concentration (i.e., when the free water has been driven out of gel or foam solution by a technique such as evaporating the working HEDPA gel or foam solutions) like an organic liquid.

In the non-nuclear industry there are components composed of nonferrous metals and alloys. For non-radioactive oxide scales, the goal of a cleaning foam and gel is convenient and efficient methods to remove the porous layer so that process efficiency can be restored. Examples include descaling an evaporator or heat exchanger and cleaning corroded bridges and tanks or hard to get places for liquid solution processing. In the first example, the effective heat transfer coefficient through the walls is improved by removing the scales, which operate as an insulator. Bridges and tanks are cleaned to remove salt products, increase aesthetic appearance, remove fluffy layers that can contribute to suspended fines, and prepare the surface for painting or sealants. The HEDPA foam and gel processes are applicable for these purposes.

Aside from dissolving the base metal oxide, other oxides might be present in the scale. Kinetic tests with the HEDPA-AHA system were performed to establish approximate dissolution rates for nonferrous metals of potential interest.

While there has been disclosed what is considered to be the preferred embodiment of the present invention, it is understood that various changes in the details may be made without departing from the spirit, or sacrificing any of the advantages of the present invention.

EXAMPLE 8

The stainless steel and carbon steel samples were washed in warm water and rinsed thoroughly with distilled water followed by ethanol rinse three to four times to clean of grease and oils on the surface. The samples were allowed to dry in the oven overnight at 100° C. The coating of sample surfaces with contaminate have been studies before and many factors are well understood (1) nitrate systems are better suited than chloride because they minimize flake oxide coatings (2) temperature as high as 700° C. are optimal for radioactive coating of surfaces, and (3) temperature of 200° C. for 10 minutes is optimal for the removal water of hydration. The Sample Dimensions were (5.08 cm×0.635 cm×0.318 cm) for the stainless steel coupons and (1.27 cm×0.635 cm×0.318 cm) for the carbon steel. Slowly pipette 100 μL of stock solution onto the coupon (TABLE 14 for radionuclide content). A pipette tip was used to spread solution over surface of sample until all the stock solution was coated onto the surface of three stainless steel and three carbon steel samples. After applying solution to the coupons were moved to the aluminum plate onto the hot plate, the sample were removed when all of the solution was evaporated. After 10 minutes of heating, the sample temperature was increased up to 700° C. and heated for two to three hours. The sample was allowed to cool to room temperature. The sample was washed and analyzed using gamma spectroscopy and liquid scintillation counting. The samples were ready for decontamination tests.

TABLE 14

Stock solution of radioactive species coated onto metallic surfaces

| Isotope | $t_{1/2}$ (yrs) | Original Cpm/μL | Radiation decay | Energy (KeV) |
|---|---|---|---|---|
| 241-Am | 432 | 2083.3 | γ | 59.5 |
| 239-Pu | $24 \times 10^3$ | 2152.6 | α | 5115.8 |
| 233-U | $14 \times 10^9$ | 953.1 | α | 4.83 |
| 99m-Tc | $6.7 \times 10^{-4}$ | 2023.6 | γ | 140 |
| 63-Ni | $2.9 \times 10^{-4}$ | 56549 | γ | 481.8 |
| 60-Co | 5.27 | 3896 | γ | 1173 |
| 59-Fe | $1.2 \times 10^{-1}$ | 3552.3 | γ | 1099 |

The decontamination factor (DF) was determined by taking the total gamma activity or alpha before decontamination divided by the total gamma or alpha activity after decontamination. Where the activity after decontamination was below detection limits, a lower limit of DF was computed based on a detection limit of 5% above background.

Gel Decontamination Test Procedure

A carbon steel sample was placed into a 50 mL beaker. Sufficient decontamination gel was added to cover the sample decontamination solution. Leave the sample sit at room temperature for a hour. The sample was removed from the beaker and observations were recorded. The reacted decontamination gel was analyzed. The gel and sample were analyzed as appropriate: (a.) liquid scintillation counting, (b) gamma spectroscopy, and (c) corrosion evaluation (SEM analysis).

$C_{10}$MimCl/HEDPA/AHA Gel

The ionic liquid based gel $C_{10}$mimCl was prepared in a 2:1 volume ratio with an HEDPA/AHA solution. The final concentration of HEDPA and AHA were 3.69 M, and 0.001 M respectively. The DF values for Plutonium and Uranium are shown in TABLE 15 as an average of the α emitters, and the average DF for Ni, Tc, Fe, Co, and Am are illustrated as the average γ emitter. In both cases, the DFs were approximately in the 15–20 range which is very impressive DFs for a one time coating at room temperature for an hour compared to other gel decontamination processes.

TABLE 15

Average decontamination factors for radioactive species after one application of the gel

| Radiation Type | Original Cpm/μL | Gel Decon Cpm/μL | Pu and U DF | Other species DF |
|---|---|---|---|---|
| α | 1573504 | 82518 | 19 | — |
| γ | 98158 | 6471 | — | 15 |

EXAMPLE 9

Foam Decontamination Test Procedure

A carbon steel sample was placed into a 50 mL beaker. Sufficient decontamination foam was added to cover the sample decontamination solution. Leave the sample sit at room temperature for a few hours. The sample was removed from the beaker and observations were recorded. The reacted decontamination foam was analyzed. The foam and sample were analyzed as appropriate: (a.) liquid scintillation counting, (b) gamma spectroscopy, and (c) corrosion evaluation (SEM analysis).

PPI/HEDPA/AHA Foam

The polymethylene polyether isocynate based foam PPI was prepared in a 10:1 volume ratio with an HEDPA/AHA solution. The final concentration of HEDPA and AHA were 6 M, and 0.001 M respectively. The DF values for Plutonium and Uranium are shown in TABLE 16 as an average of the α emitters, and the average DF for Ni, Tc, Fe, Co, and Am are illustrated as the average γ emitter. In the α emitter cases, the DFs was 890 which very impressive and for the γ emitters the DF were 136 for a once time application which is also very remarkable DFs for an hour compared to other foam decontamination processes.

TABLE 16

Average decontamination factors for radioactive species after one application of the foam.

| Radiation Type | Original Cpm/μL | Gel Decon Cpm/μL | Pu and U DF | Other species DF |
|---|---|---|---|---|
| α | 1573504 | 16100 | 890 | — |
| γ | 98158 | 720 | — | 136 |

EXAMPLE 10

The solubility of the HEDPA based foams and gels were measured with different solvents and the results are tabulated in TABLE 17. The different solvents allow the leaching or extraction from the foam or gel in a small volume which will lead to optimal concentration and disposal of the radionuclide species. The other option permits leaving the radionuclide species in the foam or gel and thermal treatment to produce a final waste form.

TABLE 17

Solubility of HEDPA based foams and gels in hydrophobic and hydrophilic solvents

| State | Solution base | HEDPA (M) | AHA (M) | Solution: HEDPA vol ratios | Mass of gel or foam (g) | Solvent and volume (mL) | Observation |
|---|---|---|---|---|---|---|---|
| gel | $C_{10}$mimCl | 11.08 | 0.001 | 3 | 0.074 | Water (1) | Very soluble |
| foam | PPI | 6 | 0.001 | 5 | 0.510 | Water (1) | Insoluble |
| foam | PPI | 6 | 0.001 | 5 | 0.020 | Acetone (2) | Very soluble |
| foam | PPI | 6 | 0.001 | 5 | 0.063 | Ethanol (2) | Very soluble |
| foam | PPI | 6 | 0.001 | 5 | 0.020 | Acetonitrile/methanol (2) | Very soluble |
| foam | PPI | 6 | 0.001 | 5 | 0.030 | Toluene (2) | Very soluble |

EXAMPLE 11

Thermal Treatment and TGA Analysis

The range of thermal decomposition temperature for materials was determined by thermogravimetric analysis using a TGA instrument (New Castle, Del.) model 2950 themogravimetric analyzer. All materials were analyzed in platinum pans with nitrogen as purge gas; the temperature was linearly increased at 10° C./min over a temperature range between 250 and 1000° C. The decomposition as a function of temperature demonstrated lost of water until about 400° C. were the complete decomposition of the organic material was observed. FIG. 4 and FIG. 5 illustrate the TGA spectrum for before and after the HEDPA based gels treatment of carbon steel samples. Furthermore, the TGA for the reacted gels show a more rapid decomposition with the presence of the dissolved metals than unreacted gels.

The embodiments of the invention in which an exclusive property or privilege is claimed are defined as follows:

1. A method of decontaminating a radioactively contaminated metal oxide by contacting said radioactively contaminated metal oxide with a diphosphonic acid based gel for a time sufficient to dissolve the metal oxide by forming a radioactive diphosphonic acid complex and subsequently decomposing the diphosphonic acid metal complex to produce a metal polymeric phosphate that can be converted to a waste form, wherein the diphosphonic acid includes 1-hydroxyethane-1,1-diphosphonic acid and is present in the gel at concentration of about 5 M.

2. A method of decontaminating a radioactively contaminated metal oxide compromising contacting said radioactively contaminated metal oxide with a diphosphonic acid based foam for a time sufficient to dissolve the metal oxide by forming a radioactive diphosphonic acid complex and subsequently decomposing the diphosphonic acid metal complex to produce a metal polymeric phosphate that can be converted physically or chemically to a waste form with minimal chemical additives wherein the diphosphonic acid includes 1-hydroxyethane-1,1-diphosphonic acid and is present in the foam at concentration of 5 M.

* * * * *